United States Patent [19]

Chen et al.

[11] 4,034,592

[45] July 12, 1977

[54] CRIMPING MACHINE WITH AUTOMATIC HINGE OPEN PUSHERS

[75] Inventors: Karl K. Chen, Cleveland Heights; Hiralal V. Patel; Irving G. Frank, both of Euclid; Donald Pistoor, Mayfield Heights, all of Ohio

[73] Assignee: The Weatherhead Company, Cleveland, Ohio

[21] Appl. No.: 672,295

[22] Filed: Mar. 31, 1976

[51] Int. Cl.[2] ..... B21D 39/00

[52] U.S. Cl. ..... 72/402; 29/237

[58] Field of Search ..... 72/402, 453.01; 29/237, 29/282

[56] References Cited

U.S. PATENT DOCUMENTS

| | | | |
|---|---|---|---|
| 2,381,748 | 8/1945 | Howe | 29/237 |
| 3,706,123 | 12/1972 | Whitledge | 29/237 |
| 3,750,452 | 8/1973 | Frank | 29/237 |
| 3,762,209 | 10/1973 | Herndon | 29/237 |
| 3,768,298 | 10/1973 | Jones | 29/237 |
| 3,851,514 | 12/1974 | Chen | 29/237 |

*Primary Examiner*—C.W. Lanham
*Assistant Examiner*—Gene P. Crosby
*Attorney, Agent, or Firm*—McNenny, Pearne, Gordon, Gail, Dickinson & Schiller

[57] ABSTRACT

A crimping machine for radially inwardly crimping an end fitting onto a hose by means of a contractible die assembly includes a reciprocable ram. A pusher assembly is mounted on the ram for transmitting ram force to the die assembly. The pusher assembly includes first and second semicircular pusher members, and the pusher members are mounted for axial movement with the ram and for lateral movement relative to the ram. The die assembly includes two disjuncted die sections, one of which is carried on the end of each pusher member by connecting means which permits relative radial movement between the die section and the pusher member. A cam follower on each pusher member follows a cam surface on the machine for moving the pushers laterally outwardly when the die sections are pulled from the socket by the pushers during retraction of the ram. During advancing movement of the ram, the cam surfaces close the pusher halves and the die sections carried on the pusher halves to form a die cavity in which the workpiece is located. Further advancing movement of the ram after the pushers and die sections come together forces the die sections into a conical socket to radially inwardly deform the workpiece.

32 Claims, 9 Drawing Figures

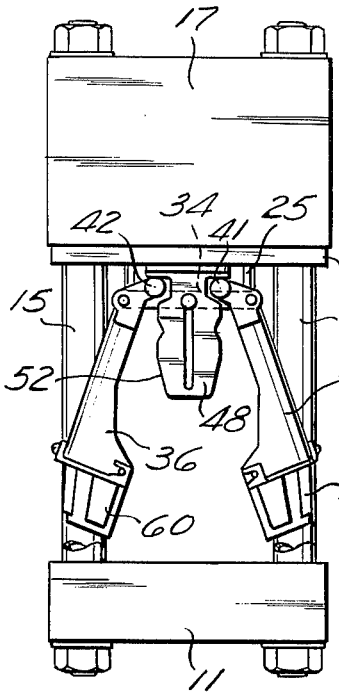
Fig. 5
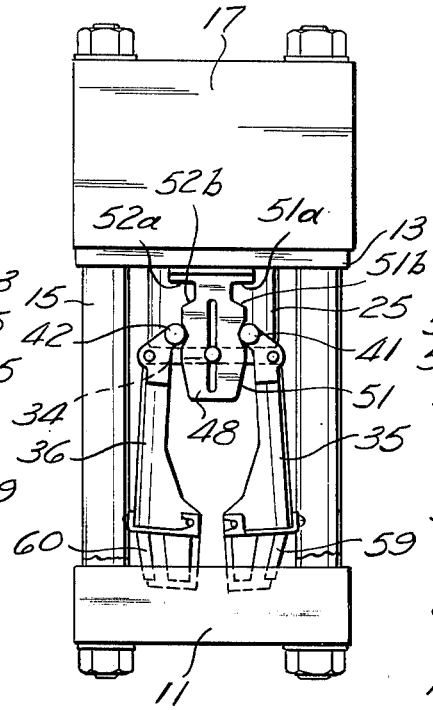
Fig. 6
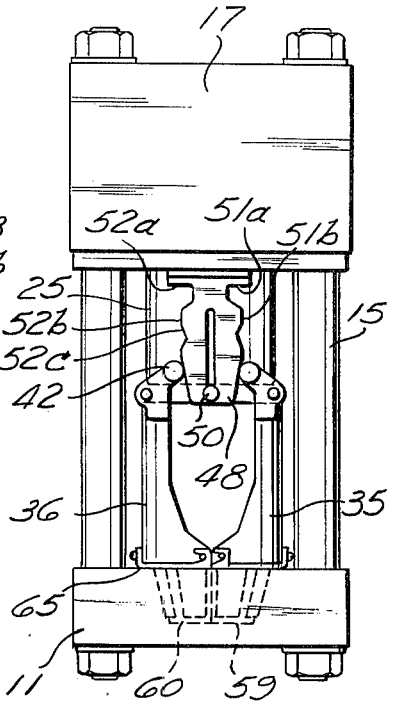
Fig. 7
Fig. 8
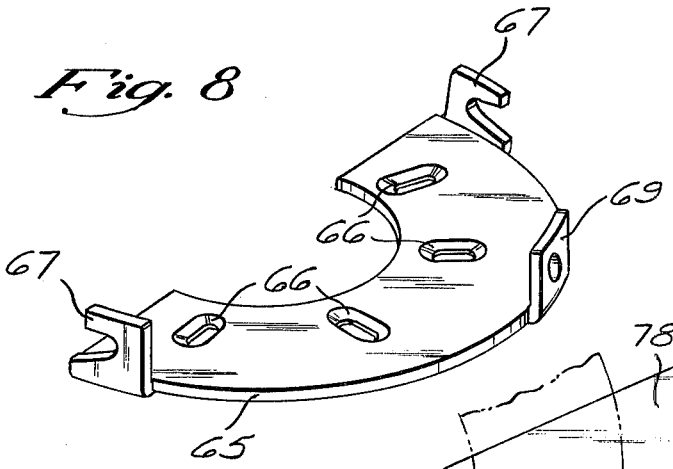
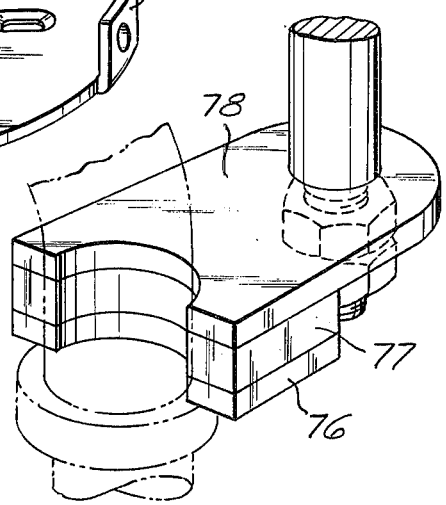
Fig. 9

CRIMPING MACHINE WITH AUTOMATIC HINGE OPEN PUSHERS

BACKGROUND OF THE INVENTION

The present invention relates to a machine for crimping an end fitting onto a hose. More particularly, the invention relates to such a machine which is capable of crimping a wide variety of types and sizes of end fittings on a wide variety of types and sizes of hose and which can be quickly and easily changed from one type and size to another.

The prior art has provided a number of machines for radially inwardly deforming a workpiece. One crimping machine which incorporates pushers between a hydraulic ram and a die assembly which can be swung open to permit removal of the workpiece and die assembly is disclosed in U.S. Pat. No. 3,851,514. A crimping machine in which several crimping die fingers are carried on a die head and a removably half of a die head is carried on a ram is disclosed in U.S. Pat. No. 3,762,209. This patent, at column 3, states that the removable half of the die head can be removed either manually or automatically. Crimping machines which include a locator for locating a workpiece are disclosed in U.S. Pat. Nos. 3,849,858 and 2,311,663. Still other crimping machines are disclosed in U.S. Pat. Nos. 3,720,088, 3,742,754 and 3,750,052. A swaging machine which forces an end fitting into a fixed die and then opens the die by axial movement of an annular plate to which the individual die portions are attached is shown in U.S. Pat. No. 3,626,450.

SUMMARY OF THE INVENTION

The present invention departs from these and other prior art machines by providing a crimping machine in which pushers located between a ram and a die assembly pull the die assembly fingers or segments from the die assembly socket and swing laterally outwardly relative to the ram to expose the die assembly fingers and socket. This permits removal of a workpiece and permits replacement of the die assembly fingers and socket if a different size is to be crimped.

The machine includes a bed plate and a ram reciprocable along a longitudinal axis toward and away from the bed plate. A pusher assembly comprising two generally semicircular cylindrical pusher members is secured to the ram. Each pusher member is pivotally mounted on the ram for lateral opening movement relative to the ram. A stationary camming surface is engaged by a cam follower on each pusher member to define the lateral opening and closing of the pusher members.

The die assembly includes a generally semicircular crimping die section secured to the free end of each pusher member and a socket secured to the bed plate. Each crimping die section includes a plurality of individual crimping die fingers or segments and resilient means biasing the crimping die segments to a radially outward position.

In a fully open position, the pusher members are swung laterally outwardly away from the socket or die ring to fully expose the die ring and crimping die sections to permit removal or insertion of a workpiece. As the ram moves toward the bed plate, the cam follower on each pusher member rides along its associated camming surface to swing the pusher members and the crimping die sections together before the die sections enter the die ring. Further movement of the ram in a direction toward the bed plate pushes the crimping die sections into the die ring.

After the crimping die sections have initially entered the die ring, each camming surface frees or releases its assoicated cam follower. This permits the operator to manually open the pushers and die sections a small amount which is sufficient to remove or insert a workpiece if the workpiece does not have an elbow or other portion which would not fit between the slightly opened die sections. This permits insertion and removal of some workpieces without requiring a full stroke of the ram. Further downward movement of the ram causes the several die segments of the two die sections to move radially inwardly to radially inwardly deform the workpiece.

When the ram is retracted, the pushers pull the two die sections longitudinally out of the die ring. Elastomeric spacers of each die section then resiliently urge the several die segments radially outwardly. Further retraction of the ram causes the cam surfaces to move the pushers laterally outwardly to fully expose the die ring and the two crimping die sections.

A holder removably secures each of the two die sections to its associated pusher member. When the ram is in its fully retracted position and the pusher members are swung open to fully expose the die ring and the crimping die sections, the crimping die sections and the die ring can be removed and replaced with a die ring and crimping die sections for crimping another size workpiece.

BRIEF DESCRIPTION OF THE DRAWINGS

These and other features and advantages of the invention will be apparent to those skilled in the art upon an understanding of the preferred embodiment of the invention shown in the accompanying drawings, wherein:

FIG. 5 is a rear view of the machine shown in FIG. 1 with the pusher members and crimping die sections in their fully open retracted positions;

FIG. 6 is a view similar to FIG. 5 but with the pusher members and crimping die sections shown in an intermediate released position;

FIG. 7 is a view similar to FIG. 5 but with the pusher members and crimping die sections shown in a fully closed advanced position;

FIG. 8 is a perspective view of a holder for removably securing the two crimping die sections to their associated pusher members; and FIG. 9 is a perspective view of an elbow locator which may be used in the machine shown in FIG. 1, with an elbow fitting shown in phantom.

DETAILED DESCRIPTION OF THE DRAWING

Figure 1:
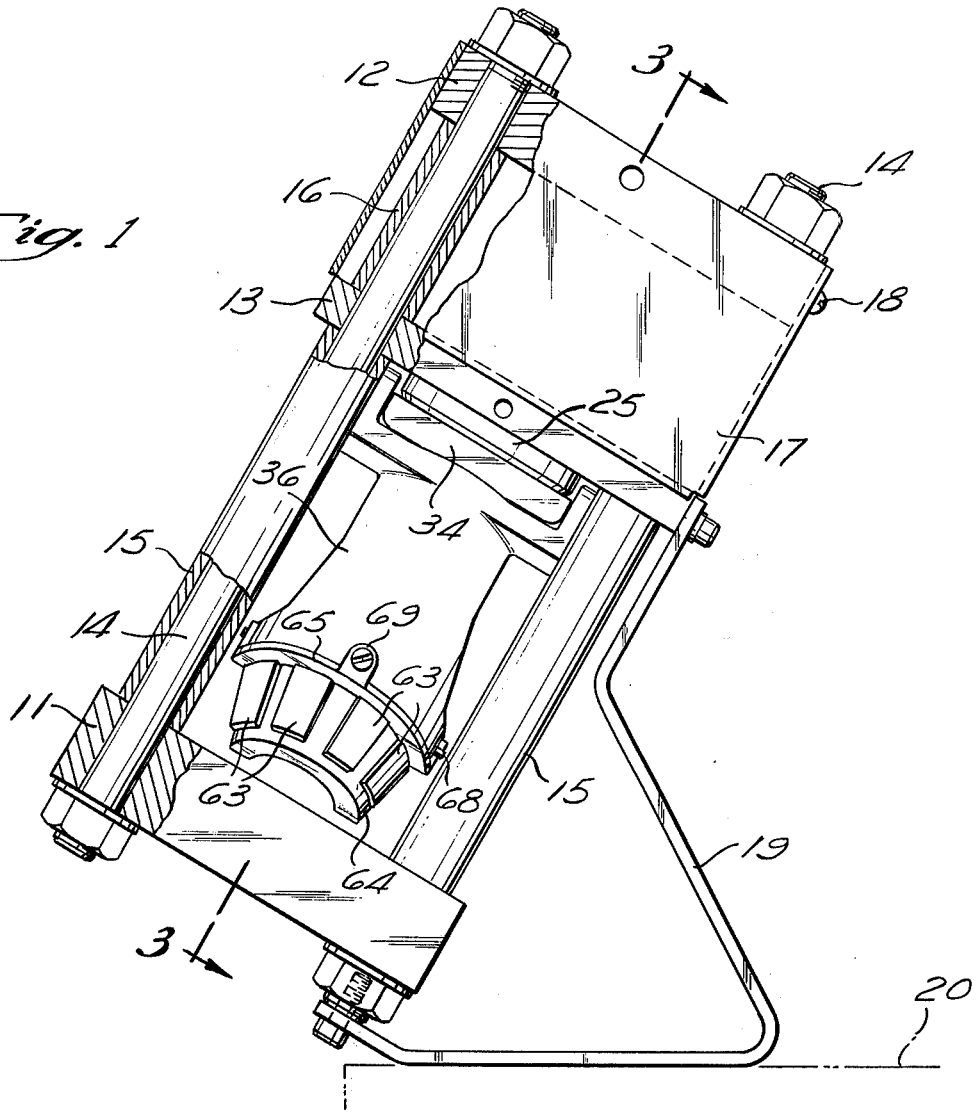
FIG. 1 is a side elevational view of the machine according to the principals of the invention with the pusher halves and the die section halves in the open position.
Figure 2:
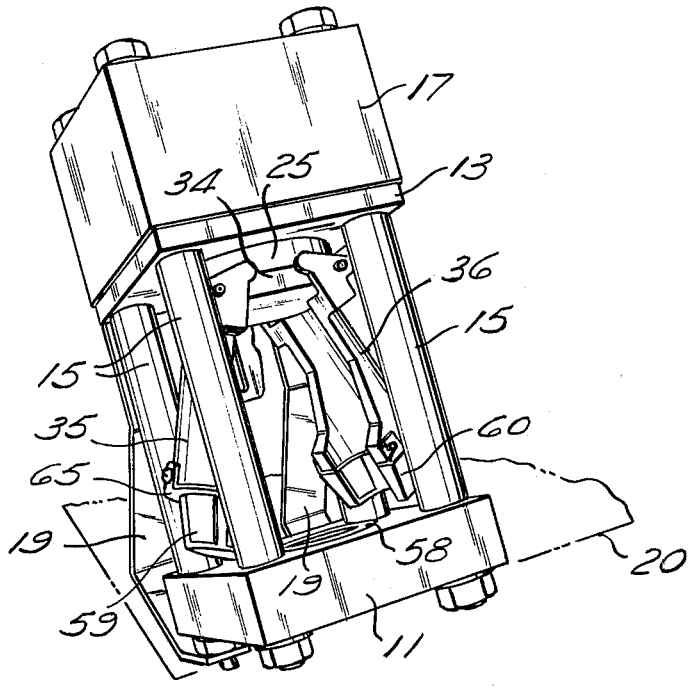
FIG. 2 is a perspective view of the machine shown in FIG. 1.

Referring now to the drawing in greater detail, FIGS. 1 and 2 show a crimping machine which includes a bed plate 11, an upper end plate 12, and a lower end plate 13. The plates 11, 12 and 13 are each generally flat rectangular steel plates which are bolted together by four identical tie bars 14 and which are spaced apart by four identical lower spacer sleeves 15 and four identical upper spacer sleeves 16. An open ended box like cover plate 17 is secured tothe upper end plate 12 by suitable fasteners 18.

Two identical mounting brackets 19 are suitably fastened at their upper end to the end plate 13 and at their lower end to one of the tie bars 14. The mounting brackets 19 mount the crimping machine on a horizontal work surface 20 so that the longitudinal axis of the ram is tilted at an angle of approxmately 30° to the vertical and so that the bottom of the bed plate 11 is unobstructed.

Figure 3:
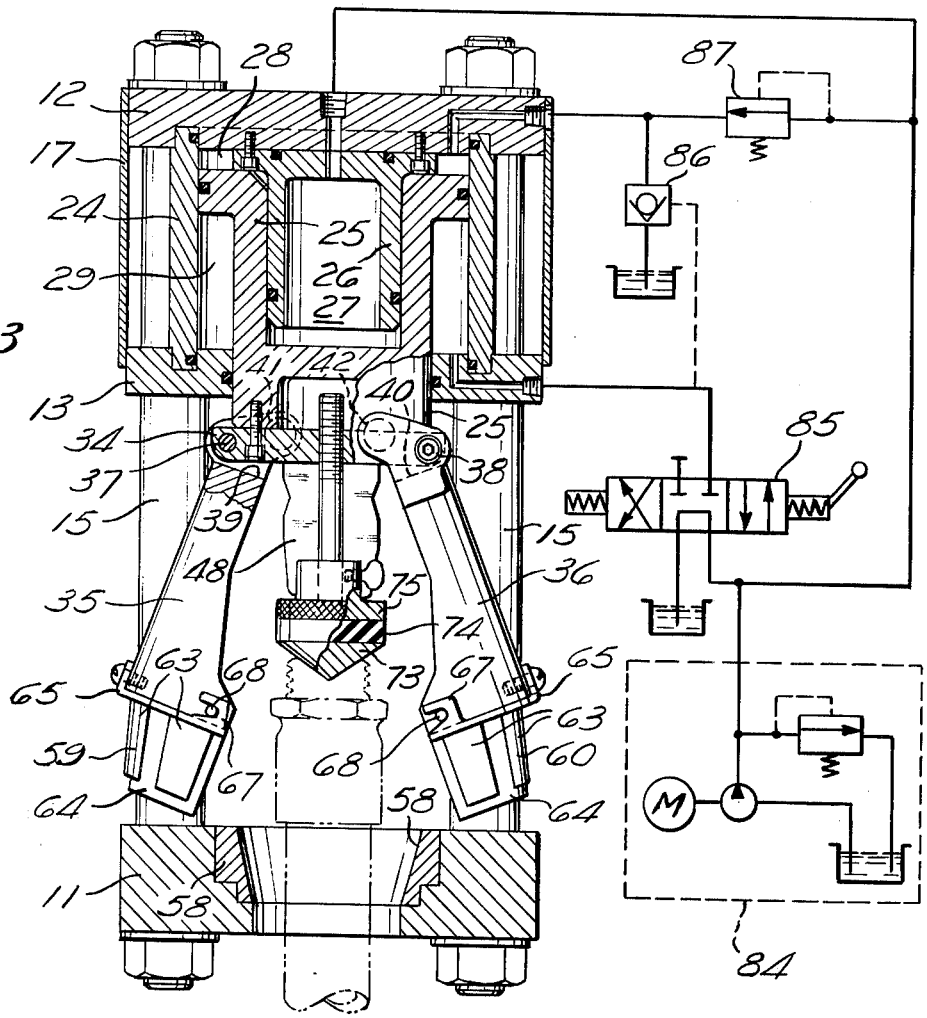
FIG. 3 is a longitudinal cross sectional view taken along reference view line 3—3 in FIG. 1, with portions shown in elevation and with the hydraulic circuit shown schematically and with an end fitting and a locator added.

Referring now to FIG. 3, an annular hydraulic cylinder 24 extends between the end plates 12 and 13. Each end of the hydraulic cylinder 24 is sealingly received in a suitable annular groove in its adjacent end plate 12 or 13 to provide a fluid tight seal therebetween. A piston 25 is slidably disposed within the hydraulic cylinder 24 and provides a ram which is movable toward and away from the bed plate 11. An internal cylinder 26 is rigidly secured to the upper end plate 12 by suitable bolts and sealingly engages the interior surface of the piston 25. The cylinder 24 and piston 25 and internal cylinder 26 cooperatively define a first advancing fluid pressure chamber 27, a second advancing fluid pressure chamber 28 and a retracting fluid pressure chamber 29.

Referring now to FIGS. 1 through 4, a generally flat rectangular ram plate 34 is bolted to the lower portion of the ram 25 for movement with the ram under all conditions. Two pusher members 35 and 36 are pivotally connected to the ram plate 34 by pivot pins 37, **37*a* and 38, 38*a* respectively, which are threaded laterally into the front and back of the ram plate 34 in a direction perpendicular to the longitudinal axis of the ram 25. The pivot pins 37, 37*a* and 38, 38*a* also extend through suitable ear portions on the top end of the pusher members 35 and 36 so that the pusher members 35 and 36 may each be swung laterally sideways when viewed from the front of the machine about a laterally extending axis which is perpendicular to the direction of the movement of the ram plate 25** and which extends in a direction from front to back of the machine.

The pusher members 35 and 36 are preferably indentical to one another and are of a suitable cast construction. The top surfaces of the pusher members 35 and 36 provide flat abutment surfaces 39 and 40, respectively, which engage the lower surface of the ram plate 34 to transmit ram force from the ram plate in a manner discussed further below. The pivot pins 37, **37*a* and 38, 38*a* are provided with a very loose fit in the bores in the ear portions through which they extend, so that the pivot pins do not carry any of the axial load exerted by the ram 25** during crimping.

Figure 4:
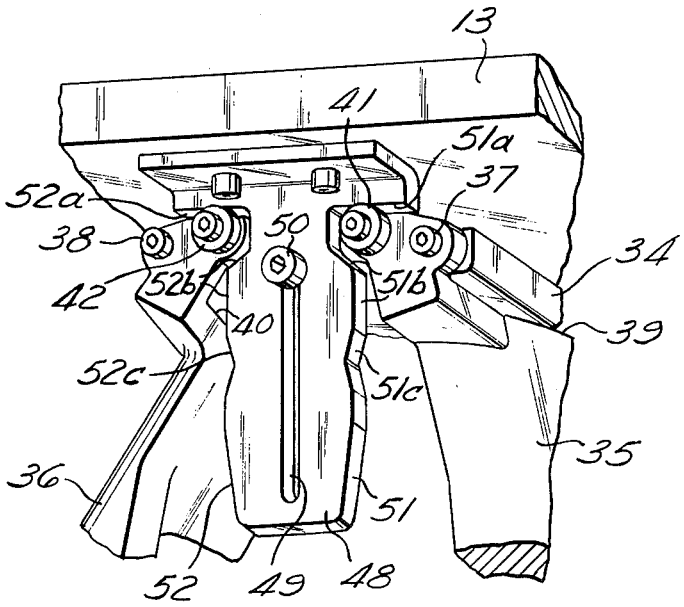
FIG. 4 is a perspective view of a portion of the rear of the machine shown in FIG. 1, showing the camming surfaces and cam followers of the machine.

As mentioned above, each of the pusher members 35 and 36 includes two ear portions at its upper end for receiving the pivot pins 37, **37*a* and 38, 38*a*. Referring to FIG. 4, the ear portions at the rear of each pusher member 35 and 36 also carry small rollers or cam followers 41 and 42, respectively, which are secured on the ear portions by a suitable bolt which is threaded into the ear portions. The rollers 41 and 42 rotate freely about an axis which is parallel to the axis of the pivot pins. The center line or axis of rotation of the rollers 41 and 42 is located above the axis of their respective pivot pins and is located laterally inwardly from the axis of the pivot pins. Additionally, the distance between the cam followers 41 and 42 and their respective pivot pins is relatively small so that a small movement of the cam followers 41 and 42 provides a relatively large movement of the bottom end of the pusher members 35 and 36**.

Still referring to FIG. 4, a cam plate 48 is bolted to the lower end plate 13 and is stationary under all conditions. A longitudinally extending slot 49 in the cam plate 48 slidably receives a suitable guide 50, which is a bolt which extends through the slot 49 and which is threadably received in the reciprocable ram plate 34. The guide 50 slides in the slot 49 as the ram 25 and the ram plate 34 move toward and away from the bed plate 11. This locks the ram 25 against rotational movement about its longtudinal to insure proper positioning of the cam followers 41 and 42 relative to the cam plate 48.

The cam plate 48 also includes a first cam surface 51 and a second cam surface 52. The first cam surface 51 defines the movement of the cam follower 41 on the pusher member 35 to swing the pusher member 35 about its pivot pin 37. In a similar manner, the second cam surface 52 defines the path of movement of the cam follower 42 to swing the pusher member 36 about its pivot pin 38. The first and second cam surfaces 51 and 52 include a cam opening surface **51*a* and 52*a*, a cam closing surface 51*b* and 52*b*, and a cam release surface 51*c* and 52*c*. The cams 51 and 52 and the followers 41 and 42** are referred to herein as mating surfaces, and the function of these surfaces is explained below.

Because of the vertical disposition of the center of gravity of the pusher members and die sections with respect to their pivot axes on the crimping machine shown in FIG. 1, the weight of the pusher members 35 and 36 acts in a direction to open the pusher members 35 and 36 partially from their fully closed positions. If desired, a compression spring or a tention spring can be added to act between the pusher members 35 and 36 to urge them toward their open or closed positions. Whatever arrangment is used in this regard, the cam surfaces 51 and 52 insure that the pusher members 35 and 36 are closed upon initial downward movement of the ram 25 under all conditions.

Referring now in particular to FIGS. 1—3 and 8, the crimping machine also includes a die assembly which includes an annular die ring or socket 58, a first die section 59 and a second die section 60. The die ring 58 is removably disposed in a stepped bore in the bed plate 11. The die ring 58 is manually removable from the bed plate 11 by lifting it upwardly as viewed in the drawings for replacement with another die ring of a different size. The die ring 58 includes an internally coned surface for forcing the die sections 59 and 60 radially inwardly as explained further below.

Each of the die sections 59 and 60 is of generally semicircular configuration and includes four separate die segments 63. An internal surface of each die segment 63 cooperatively defines a die cavity in which a workpiece may be disposed when the die sections 59 and 60 are closed together. Each of the die sections 59 and 60 also includes a molded resilient elastomeric spacer 64 which holds the die segments 63 in their proper positions relative to one another and which provides a resilient force for returning the die segments 63 to a radially outwardly position when they are pulled from the die ring 58.

By this arrangment of the die sections 59 and 60, the die sections 59 and 60 are individually removed from the die ring 58 by their associated pusher members 35 and 36, respectively. This permits the die sections 59 and 60 to be separated by lateral movement of the pusher members 35 and 36 to permit insertion and removal of a workpiece. Additionally, when the pusher members 35 and 36 swing laterally to the open position shown in FIGS. 2 and 3, the die ring 58 and the die sections 59 and 60 are fully exposed to permit removal and replacement thereof.

As best shown in FIGS. 3 and 8, the die sections 59 and 60 are each removably secured to their associated pusher members 35 and 36 by a carrier member 65. As best shown in FIG. 8, the carrier member 65 is a one piece generally flat semicircular member. The carrier member 65 includes four elongated holes 66. Each of the holes 66 receives a flat head machine screw which is threaded into one of the die segments 63 to fasten each of the die sections 59 and 60 to its associated carrier member 65. The flat head machine screws slide radially inwardly and outwardly in the slotted holes 66 as the die segments 63 move radially inwardly and outwardly during operation of the machine. The carrier member 65 also includes two notched tabs 67 which fit over laterally outwardly projecting pins 68 (FIG. 3) on the pusher members 35 and 36. A third tab 69 having a hole extending therethrough receives a suitable machine screw which is threaded into its associated one of the pusher members 35 and 36 after the slotted tabs 67 are placed over the pins 68. In this manner, the carrier members 65 removably secure the first and second die sections 59 and 60 to the pusher members 35 and 36 (FIG. 3).

A fitting locator, shown in FIG. 3 and omitted from the rest of the drawings for simplicity, is provided to locate a loosely assembled hose and end fitting. The loosely assembled hose and end fitting which are to be crimped by the machine are shown in phantom outline in FIG. 3. The locator includes a rigid metal stop 73, a resilient spacer 74, and a rigid metal connector 75 which is rigidly and adjustably secured to the ram plate 34 for movement with the ram 25. When a hose and end fitting are to be crimped, the pre-assembled hose and fitting are inserted into the machine from the bottom of the bed plate 11 and held against the stop member 73 by the operator grasping the hose beneath the bed plate 11. This locates the fitting member so that the crimping will occur at the proper location on the fitting member. When the fitting is crimped radially inwardly, the resilient spacer 74 is compressed to shorten its longitudinal extent to compensate for any longitudinal elongation of the fitting that occurs as a result of radially inward deformation of the fitting.

A second type of fitting locator for use in the disclosed crimping machine when the fitting to be crimped on the hose includes an elbow or other laterally outwardly extending portion is shown in FIG. 9. When the elbow locator shown in FIG. 9 is used, the straight fitting locator shown in FIG. 3 is removed from the ram plate 34 by removing the threaded shaft of the straight locator shown in FIG. 3 from its associated threaded hole in the ram plate 34. The elbow locator shown in FIG. 9 includes a rigid metallic stop member 76, a resilient spacer 77, and a connector 78. When the connector shown in FIG. 9 is used in the crimping machine disclosed in this application, a threaded rod of the connector 78 is threadably secured in a suitable hole (not shown) in the ram plate 34. A shoulder of the fitting which is to be crimped (shown in phantom in FIG. 9) is held against the stop member 76 by the operator holding the hose at a location beneath the bed plate 11 and lightly urging the shoulder of the fitting against the stop member 76 during crimping. The resilient spacer 77 is compressed and reduced in its longitudinal extent during crimping to accommodate any longitudinal elongation of the fitting resulting from radially inward contraction of the fitting.

Referring now to FIG. 3, the hydraulic circuit for the crimping machine is shown schematically. The hydraulic circuit includes a power pack 84 which includes a high-low pump (also known as a dual displacement pump) driven by an electric motor and a relief valve. The high-low pump has an output of one gallon per minute at pressures above 1,000 psi and has an output of 2.5 gallons per minute at pressures below 1,000 psi. The relief valve is set at a relief pressure of 4,100 psi.

The hydraulic circuit shown in FIG. 3 also includes a manually actuated self centering four-way valve 85. A pilot operated one-way check valve 86 is provided which permits flow in a direction from the reservoir under all conditions and which opens to permit the flow to the reservoir when a pressure signal is received. A sequence valve 87 blocks fluid flow at pressures below 3,800 psi and opens to permit flow only at pressures above 3,800 psi.

Turning now to the operation of the crimping machine, the fully open position may be explained by reference to FIGS. 3, 4 and 5. In this position, the opening cam surfaces 51*a* and 52*a* act against the cam followers 41 and 42 to open the pusher members 35 and 36. This exposes the die ring 58 and the first and second die sections 59 and 60 and provides unobstructed access thereto for removal thereof as well as for removal and insertion of a workpiece.

To commence a crimping cycle, the valve 85 is manually moved rightwardly from its center position and the motor of the power pack 84 is started to provide a high volume low pressure output flow of the pump. This output flow from the pump at lower pressure can flow only into the first advancing fluid pressure chamber 27. This provides initial rapid downward movement of the ram 25, with the retracting fluid pressure chamber 29 connected to the reservoir by the valve 85 and with the second advancing fluid pressure chamber 28 filled by sucking fluid from the reservoir through the check valve 86.

As the ram 25 begins its downward movement from its fully retracted position shown in FIG. 5, the closing cam surfaces 51*b* and 52*b* push the cam followers 41 and 42 laterally outwardly to swing the pusher members 35 and 36 about their respective pivot pins 37, 37*a* and 38, 38*a* to close the pusher members 35 and 36. This may be termed a first intermediate position in which the first and second die sections 59 and 60 are brought together prior to their entry into the internally coned surface of the die ring 58.

The ram 25 continues this downward movement with the pusher members 35 and 36 and the die sections 59 and 60 closed until a second intermediate position shown in FIG. 6 is reached. In this position, the cam followers 41 and 42 are aligned with the cam release surfaces 51*c* and 52*c*. When this occurs, the cam followers 41 and 42 are released from the cam closing surfaces 51*b* and 52*b*, respectively, so that, with the die sections 59 and 60 partially into the die ring 58, the pusher members 35 and 36 and the die sections 59 and 60 are partially open. This permits insertion and removal of a workpiece through the bottom of the bed plate 11 if the largest outer diameter of the workpice is sufficiently small to fit into the partially closed die sections 59 and 60. For such fittings, the crimping machine need only be retracted to and advanced from this second intermediate position and need not be fully retracted.

When the crimping machine is in this second intermediate position shown in FIG. 6 and the ram 25 is further advanced, the low pressure fluid continues to flow from the pump to the first advancing fluid pressure chamber 27. The second advancing fluid pressure chamber 28 continues to be filled from the reservoir through the check valve 86, and the retracting fluid pressure chamber 29 is drained to the reservoir. When the eight individual die segments 63 of the die sections 59 and 60 are first contracted radially inwardly by the internal conical surface of the die ring 58 to begin to deform the workpiece, the outlet pressure of the pump begins to increase. When the outlet pressure of the pump reaches 3,800 psi, the sequence valve 87 opens. This supplies full fluid pressure from the pump to both the first advancing fluid pressure chamber 27 and the second advancing fluid pressure chamber 28 so that the full end face of the ram 25 is exposed to high fluid pressure to move the ram 25 at a slower speed but with a greater force until the crimping of the workpiece is completed. It may be noted that, as the ram 25 and the pusher members 35 and 36 advance from the intermediate position shown in FIG. 6 to the fully advanced position shown in FIG. 7, the cam followers 41 and 42 need not engage the cam plate 48. This is because the die sections 59 and 60 are already in the die ring 58 so that the cam followers 41 and 42 are no longer required to hold the pusher members 35 and 36 closed.

When the fully advanced position shown in FIG. 7 is reached and it is desired to retract the ram 25, the valve 85 is moved leftwardly from its center position. This supplies pressure from the power pack 84 to the retracting fluid pressure chamber 29 to move the ram 25 upwardly. During this portion of the operation of the machine, fluid pressure from the pump is also supplied to the first advancing fluid pressure chamber 27, but the net lateral cross sectional area of the ram 25 exposed to downward action pressure in the chamber 27 is less than the net lateral cross sectional area of the ram 25 exposed to fluid pressure in the retracting chamber 29. Hence, the net force on the ram is upward. The upward motion of the ram pumps the fluid from chamber 27 into the retracting chamber 29, thus increasing the retraction speed. During this retraction, a pressure signal supplied to the pilot operated check valve opens the check valve 86 to communicate the chamber 28 to the reservoir.

When the intermediate position shown in FIG. 6 is reached, the crimped fitting and hose may be removed if it is small enough as described above. If it is not small enough to be removed in the intermediate position, the ram 25 continues to retract. When the ram 25 is further retracted, the opening cam surfaces 51*a* and 52*a* assure full opening of the pusher members 35 and 36. This permits removal of the workpiece and insertion of a subsequent workpiece. Additionally, as also explained above, this fully exposes the die ring 58 and the die sections 59 and 60 if they are to be changed for a different size or type of fitting.

We claim:

1. A machine for radially deforming a workpiece comprising a bed plate, a ram reciprocable along a longitudinal axis toward and away from said bed plate, a die assembly for receiving said workpiece, and a longitudinally extending pusher member disposed between said ram and said die assembly, said die assembly including a socket and a die section, said die section including a plurality of die segments and resilient means acting between adjacent ones of said die segments, said die segments each having an internal surface defining a part of a die cavity, first mounting means mounting said pusher member for longitudinal movement with said ram and for lateral movement along a predetermined path relative to said ram between a ram force transmitting position and a laterally disposed position, and second mounting means mounting said die section on said pusher member for longitudinal movement with said pusher member and said ram and for lateral movement with said pusher member relative to said ram.

2. A machine for radially deforming a workpiece as set forth in claim 1 wherein said second mounting means includes a connector constructed and arranged to mount said die section for radial movement of said die segments relative to said pusher member when said pusher member is in said ram force transmitting position.

3. A machine for radially deforming a workpiece as set forth in claim 1 including a stationary mating surface member and a movable mating surface member, said mating surface members being constructed and arranged to move said pusher member laterally from said laterally disposed position to said force transmitting position when said ram is advanced toward said bed plate and to move said pusher member laterally from said force transmitting position to said laterally disposed position when said ram is retracted away from said bed plate.

4. A machine for radially deforming a workpiece as set forth in claim 1 wherein said first mounting means includes a pivot member constructed and arranged to pivotally mount said pusher member on said ram for lateral swinging movement about an axis which is substantially perpendicular to said longitudinal axis.

5. A machine for radially deforming a workpiece as set forth in claim 4 wherein said machine includes a front, a back, and two sides, and said second mentioned axis extends in a direction from said front side to said back side.

6. A machine for radially deforming a workpiece as set forth in claim 1 wherein said pusher member and said die section are each generally semi-circular.

7. A machine for radially deforming a workpiece as set forth in claim 6 including a second pusher member substantially identical to said first pusher member, third mounting means substantially identical to said first mounting means mounting said second pusher member on said ram, a second die section, and fourth mounting means substantially identical to said second mounting means mounting said second die section on said second pusher member.

8. A machine for radially deforming a workpiece comprising a bed plate, a ram reciprocable along a longitudinal axis toward and away from said bed plate, a die assembly for receiving said workpiece, and a longitudinally extending pusher member disposed between said ram and said die assembly, said pusher member having one end adjacent said ram and another end adjacent said die assembly, said die assembly including an internally coned socket and an externally coned die section constructed and arranged to move into and out of said socket, said die section including a plurality of die segments each having an externally coned surface and an internal surface forming a part of a die cavity, mounting means mounting said pusher member for longitudinal movement with said ram and for lateral movement relative to said ram, and connector means connecting said die section on said pusher member for longitudinal movement with said pusher member into and out of said socket and for lateral movement with said pusher member when said die section is out of said socket.

9. A machine for radially deforming a workpiece as set forth in claim 8 wherein said mounting means includes a pivot member constructed and arranged to pivotally secure said one end of said pusher member to said ram for lateral swinging movement of said pusher member relative to said ram, and said connector means removably secures said die section t0 said other end of said pusher member.

10. A machine for radially deforming a workpiece as set forth in claim 9 wherein said connector means includes a generally flat plate disposed between said die section and said other end of said pusher member, means slidably securing each of said die segments to said plate for lateral movement relative to said plate, and hook means removably securing said plate to said other end of said pusher member.

11. A machine for radially deforming a workpiece as set forth in claim 9 wherein said ram and said one end of said pusher member each includes a generally flat abutment surface, said abutment surfaces being in force transmitting engagement when said pusher member is in said force transmitting position, and said abutment surfaces being separated from one another when said pusher member is in said laterally disposed position.

12. A machine for radially deforming a workpiece as set forth in claim 9 wherein said pivotal mounting means includes a pivotal axis, and said pivotal axis is substantially perpendicular to said longitudinal axis.

13. A machine for radially deforming a workpiece as set forth in claim 8 including a stationary cam surface, and a cam follower secured to said pusher member, said cam surface being constructed and arranged to move said pusher member between said laterally disposed position and said force transmitting position during a portion of the longitudinal movement of said ram when said die section is removed from said socket.

14. A machine for radially deforming a workpiece as set forth in claim 13 wherein said stationary cam surface includes a release surface which is aligned with said cam follower when said die section is only partially received in said socket to permit partial lateral movement of said pusher member and said die section.

15. A machine for radially deforming a workpiece comprising a bed plate, a ram reciprocable along a longitudinal axis toward and away from said bed plate, a die assembly for receiving said workpiece, and a longitudinally extending pusher member disposed between said ram and said die assembly, said pusher member having one end adjacent said ram and another end adjacent said die assembly, said die assembly including an internally coned socket and an externally coned die section constructed and arranged to move into and out of said socket, said die section including a plurality of die segments each having an externally coned surface and an internal surface forming a part of a die cavity, mounting means mounting said pusher member for longitudinal movement with said ram and for lateral movement relative to said ram, connector means connecting said die section on said pusher member for longitudinal movement with said pusher member into and out of said socket and for lateral movement with said pusher member when said die section is out of said socket, and a workpiece locator, said workpiece locator having a rigid locator member, a rigid connector member rigidly secured to said ram for longitudinal movement with said ram, and a resilient elastomeric spacer member disposed between said locator member and said connector member providing the sole means for securing said locator member to said connector member, said locator member being constructed and arranged to engage said workpiece for longitudinal and lateral positioning of said workpiece, and said resilient elastomeric spacer member being constructed and arranged to longitudinally compress to compensate for longitudinal elongation of said workpiece during crimping.

16. A machine for radially deforming a workpiece as set forth in claim 15 wherein said locator member is a conical member with the tip thereof pointed toward said bed plate, and said tip is constructed and arranged to be received within an opening in said workpiece.

17. A machine for radially deforming a workpiece as set forth in claim 15 wherein said locator is a flat semicircular plate disposed parallel to said bed plate, and said semicircular plate is constructed and arranged to engage a shoulder of the workpiece and to extend around a projecting portion of the workpiece.

18. A machine for radially deforming a workpiece comprising a bed plate, a ram reciprocable along a longitudinal axis toward and away from said bed plate, a die assembly for receiving said workpiece, and two longitudinally extending pusher members disposed between said ram and said die assembly, said pusher members each having one end adjacent said ram and another end adjacent said die assembly, said die assembly including a die ring having a socket carried on said bed plate and two die sections, each of said die sections including a plurality of die segments and resilient means acting between adjacent ones of said die segments, said die segments each having an internal surface, said internal surfaces cooperatively defining a die cavity, mounting means mounting each of said pusher members for longitudinal movement with said ram and for lateral movement relative to said ram between a laterally disposed position and a ram force transmitting position, and connector means connecting each of said die sections on one of said pusher members for longitudinal movement with said pusher members into and out of said socket and for lateral movement with said pusher members when said die sections are out of said socket.

19. A machine for radially deforming a workpiece as set forth in claim 18 wherein said mounting means includes a pivot member constructed and arranged to pivotally connect each of said one ends of said pusher members to said ram for pivotal movement about a pivot axis, and said pivot axis is substantially perpendicular to said longitudinal axis.

20. A machine for radially deforming a workpiece as set forth in claim 18 wherein said ram is movable from a fully retracted position to a first intermediate position, from said first intermediate position to a second intermediate position, and from said second intermediate position to a fully advanced position.

21. A machine for radially deforming a workpiece as set forth in claim 19 wherein said pusher members are in said laterally disposed position and said die sections are removed from said socket when said ram is in said fully retracted position, said pusher members are in said ram force transmitting position and said die sections are removed from said socket when said ram is in said first intermediate position, said pusher members are in said force transmitting position and said die sections are partially received in said socket when said ram is in said second intermediate position, and said pusher members are in said ram force transmitting position and said die sections are further received in said socket when said ram is in said fully advanced position.

22. A machine for radially deforming a workpiece comprising a bed plate, a ram reciprocable along a longitudinal axis toward and away from said bed plate, a die assembly for receiving said workpiece, and two longitudinally extending pusher members disposed between said ram and said die assembly, said pusher members each having one end adjacent said ram and another end adjacent said die assembly, said die assembly including a die ring having an internally coned socket carried on said bed plate and two die sections, each of said die sections including a plurality of die segments and resilient means acting between adjacent ones of said die segments, said die segments each having an internal surface, said internal surfaces cooperatively defining a die cavity, mounting means mounting each of said pusher members for longitudinal movement with said ram and for lateral swinging movement relative to said ram between a laterally disposed position and a ram force transmitting position, connector means connecting each of said die sections on one of said pusher members for longitudinal movement with said pusher members and for lateral swinging movement with said pusher members relative to said ram, stationary mating surface means and movable mating surface means, said mating surface means being constucted and arranged to move each of said pusher members laterally from said laterally disposed position to said force transmitting position when said ram is advanced toward said bed plate and to move said pusher members laterally from said force transmitting position to said laterally disposed position when said ram is retracted away from said bed plate.

23. A machine for radially deforming a workpiece as set forth in claim 22 wherein said stationary mating surface means includes stationary cam surfaces, said movable mating surface means includes a cam follower being carried on each of said pusher members, and said cam surfaces are constructed and arranged to move each of said pusher members between said laterally disposed position and said force transmitting position during a portion of the longitudinal movement of said ram when said die sections are removed from said socket.

24. A machine for radially deforming a workpiece as set forth in claim 23 wherein said cam surfaces include release surfaces which are aligned with each of said cam followers when said die sections are only partially received in said socket to permit partial lateral swinging movement of said pusher members and said die sections.

25. A machine for radially deforming a workpiece comprising a bed plate, a ram reciprocable along a longitudinal axis toward and away from said bed plate, a die assembly for receiving said workpiece, and a longitudinally extending pusher member disposed between said ram and said die assembly, said die assembly including a socket and a die section, said die section includng a plurality of die segments and resilient means acting between adjacent ones of said die segments, said die segments each having an internal surface partially defining a die cavity, mounting means mounting said pusher member for longitudinal movement with said ram and for lateral swinging movement about a pivotal axis relative to said ram between a ram force transmitting position and a laterally disposed position, and said pivotal axis being substantially perpendicular to said longitudinal axis.

26. A machine for radially deforming a workpiece as set forth in claim 25 including a stationary mating surface member, and a movable mating surface member secured to said pusher member, said mating surface members being constructed and arranged to move said pusher member laterally from said laterally dipsosed position to said force transmitting position when said ram is advanced toward said bed plate and to move said pusher member laterally from said force transmitting position to said laterally disposed position when said ram is retracted away from said bed plate.

27. A machine for radially deforming a workpiece as set forth in claim 25 wherein said machine includes a front, a back, and two sides, and said pivotal axis extends in a direction from said front side to said back side.

28. A machine for radially deforming a workpiece as set forth in claim 26 wherein said pusher members includes one end adjacent said ram and another end adjacent said bed plate, and said mounting means includes a pivot member disposed on said one end.

29. A machine for radially deforming a workpiece comprising a bed plate, a ram reciprocable along a longitudinal axis toward and away from said bed plate, a die assembly for receiving said workpiece, and two longitudinally extending pusher members disposed between said ram and said die assembly, said pusher members each having one end adjacent said ram and another end adjacent said die assembly, said die assembly including a die ring having an internally coned socket carried on said bed plate and at least one die section having a plurality of die segments and resilient means acting between adjacent ones of said die segments, said die segments each having an internal surface, said internal surfaces each defining a part of a die cavity, mounting means mounting each of said pusher members for longitudinal movement with said ram and for lateral swinging movement about a pivotal axis relative to said ram between a laterally disposed position and a ram force transmitting position, and said pivotal axes each being generally perpendicular to said longitudinal axis.

30. A machine for radially deforming a workpiece as set forth in claim 29 including a stationary cam surface, and a cam follower secured to each of said pusher members, said cam surface being constructed and arranged to move said pusher members between said laterally disposed position and said force transmitting position during a portion of the longitudinal movement of said ram.

31. A machine for radially deforming a workpiece as set forth in claim 29 wherein said machine includes a front, a back, and two sides, said pivotal axes each extend in a direction from said front side to said back side, and said axes are substantially parallel to one another.

32. A machine for radially deforming a workpiece as set forth in claim 30 wherein said ram and each of said pusher members include a generally flat abutment surface, said abutment surfaces of said ram and each of said pusher members being in force transmitting engagement when said pusher members are in said force transmitting position, and said abutment surfaces being separated from one another when said pusher members are in said laterally disposed position.

* * * * *

UNITED STATES PATENT OFFICE

CERTIFICATE OF CORRECTION

Patent No. 4,034,592 Dated July 12, 1977

Inventor(s) Karl K. Chen et al.

It is certified that error appears in the above-identified patent and that said Letters Patent are hereby corrected as shown below:

Column 3, line 1, delete "DRAWING" and insert -- DRAWINGS --.

Column 3, line 3, delete "drawing" and insert -- drawings --.

Column 4, line 21, after "longtudinal" insert -- axis --.

Column 7, line 51, delete "action" and insert -- acting --.

Column 9, line 26, delete "tO" and insert -- to --.

Signed and Sealed this

Eleventh Day of October 1977

[SEAL]

Attest:

RUTH C. MASON
Attesting Officer

LUTRELLE F. PARKER
Acting Commissioner of Patents and Trademarks